US009212000B1

(12) United States Patent
McDonough

(10) Patent No.: US 9,212,000 B1
(45) Date of Patent: Dec. 15, 2015

(54) METHOD AND APPARATUS FOR BAGGING TRASH

(71) Applicant: James B. McDonough, Mobile, AL (US)

(72) Inventor: James B. McDonough, Mobile, AL (US)

( * ) Notice: Subject to any disclaimer, the term of this patent is extended or adjusted under 35 U.S.C. 154(b) by 0 days.

(21) Appl. No.: 14/532,061

(22) Filed: Nov. 4, 2014

(51) Int. Cl.
*B65B 67/04* (2006.01)
*B65F 1/14* (2006.01)
*B65B 67/12* (2006.01)

(52) U.S. Cl.
CPC ..... *B65F 1/1415* (2013.01); *B65B 67/1238* (2013.01)

(58) Field of Classification Search
CPC B65B 67/1238; B65B 67/1255; B65B 67/04; B65B 67/1233; B65F 1/415
USPC ..... 248/100, 99, 95; 141/316; 211/49.1, 211/85.15
See application file for complete search history.

(56) References Cited

U.S. PATENT DOCUMENTS 4,572,559 A 2/1986 Gainey
4,815,866 A * 3/1989 Martone ..... B65B 67/1238 141/390
4,832,292 A * 5/1989 Beckham ..... B65B 67/1238 141/316
D304,872 S 11/1989 Jebb
5,000,406 A 3/1991 Petersen
5,065,965 A * 11/1991 Aulabaugh ..... B65B 67/1205 141/316
D360,510 S 7/1995 Slovak
6,450,461 B1 9/2002 Lohmann
D513,352 S 12/2005 Weathers et al.
D581,228 S 11/2008 Meehan
8,720,833 B2 * 5/2014 Jack ..... B65B 67/04 248/100
2011/0260013 A1 * 10/2011 Richardson ..... B65B 67/04 248/99

* cited by examiner

*Primary Examiner* — Todd M Epps
(74) *Attorney, Agent, or Firm* — George L Williamson

(57) ABSTRACT

Method and apparatus for an inlet scoop having a larger inlet end and an oppositely disposed smaller outlet end designed so that a conventional trash bag opening can be placed over the smaller end of the inlet scoop and hooked over a protuberance disposed on each corner of the smaller end so that the trash bag can be secured to the inlet scoop. The inlet scoop is generally rectangular shaped so that it can be placed on the surface of the ground and maintain itself in an upright position and has an enlarged portion disposed on each corner to provide additional clearance for the protuberance when the inlet scoops are stacked on top of each other so that no damage is done to the protuberance.

5 Claims, 2 Drawing Sheets

FIG. 1
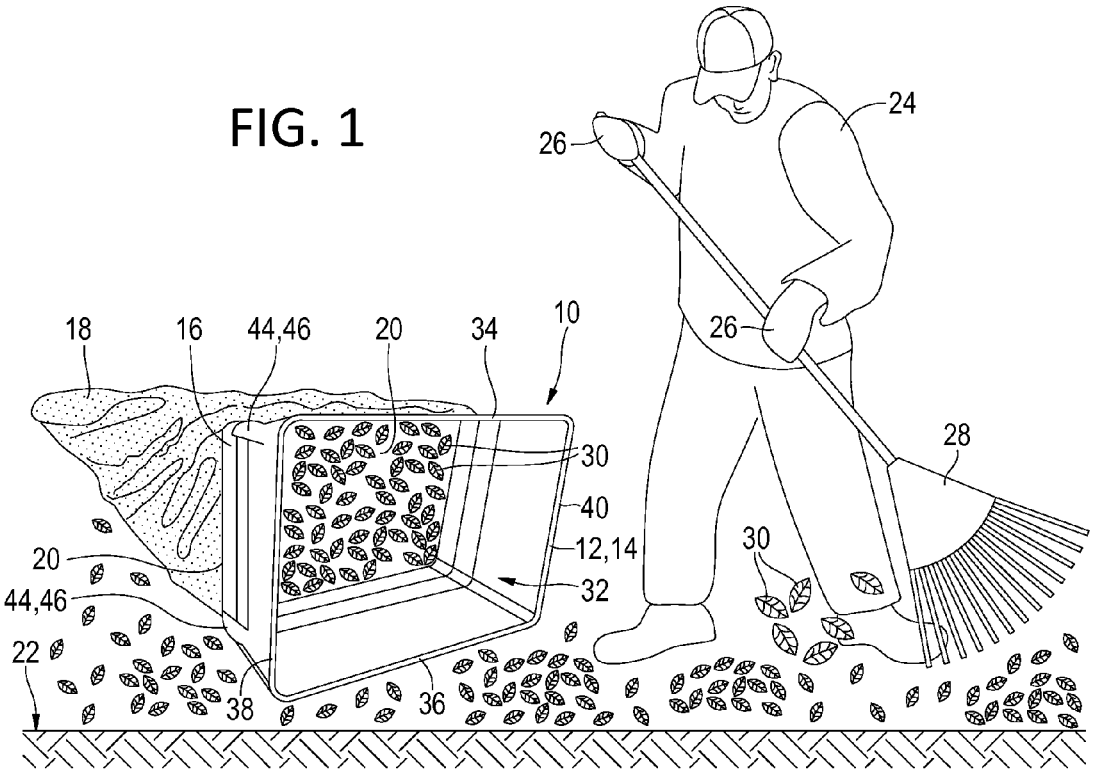
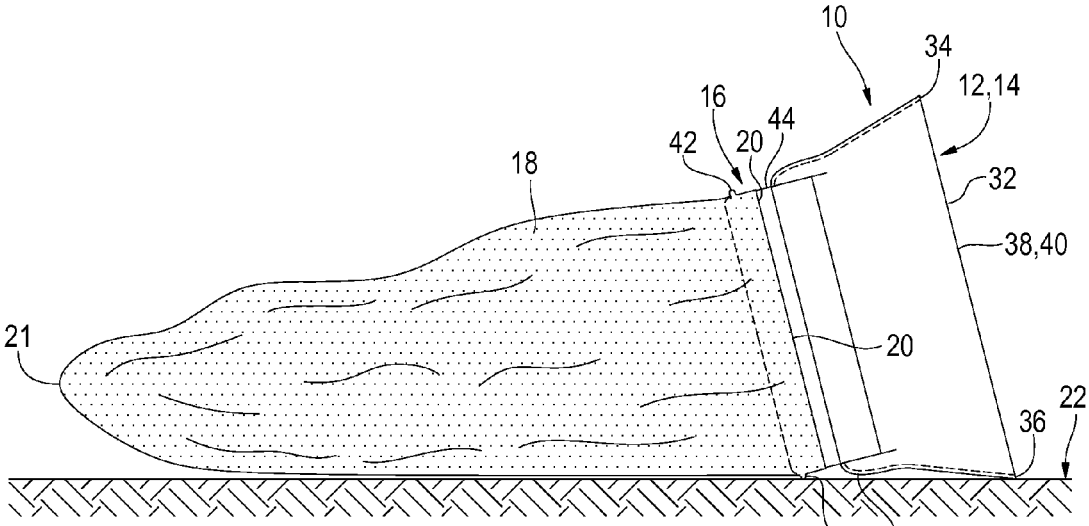
FIG. 2

METHOD AND APPARATUS FOR BAGGING TRASH

BACKGROUND OF THE INVENTION

1. Field of the Invention

The present invention relates generally to the field of trash bagging and, more particularly, is concerned with a method and apparatus for holding open a trash bag so that trash, leaves and other debris can be swept or raked into the bag in an easy and convenient manner so that the hands of a user are free to rake.

2. Description of the Related Art

Devices relevant to the present invention have been described in the related art, however, none of the related art devices disclose the unique features of the present invention.

In U.S. Pat. No. D581,228 dated Nov. 25, 2008, Meehan disclosed a leaf scoop. In U.S. Pat. No. D513,352 dated Dec. 27, 2005, Weathers, et al., disclosed a leaf chute. In U.S. Pat. No. 6,450,461 dated Sep. 17, 2002, Lohmann disclosed a trash bag holder. In U.S. Pat. No. D360,510 dated Jul. 18, 1995, Slovak disclosed a container funnel. In U.S. Pat. No. 5,065,965 dated Nov. 19, 1991, Aulabaugh disclosed a trash bag holder. In U.S. Pat. No. 5,000,406 dated May 19, 1991, Petersen disclosed an apparatus for catching leaves or other debris. In U.S. Pat. No. 4,832,292 dated May 23, 1998, Beckham disclosed a method and apparatus for holding a trash bag. In U.S. Pat. No. 4,572,559 dated Feb. 25, 1986, Gainey disclosed a scoop for gathering leaves, debris, and the like. In U.S. Patent Application Publication No. 2011/0260013 dated Oct. 27, 2011, Richardson disclosed a bag master system. In U.S. Pat. No. D304,812 dated Nov. 28, 1989, Jebb disclosed a trash funnel.

While these devices may be suitable for the purposes for which they were designed, they would not be as suitable for the purposes of the present invention as hereinafter described. As will be shown by way of explanation and drawings, the present invention works in a novel manner and differently from the related art.

SUMMARY OF THE PRESENT INVENTION

The present invention discloses an inlet scoop having a larger end and an oppositely disposed smaller end designed so that a conventional trash bag opening can be placed over the smaller end of the inlet scoop and hooked over a protuberance disposed on each corner of the smaller end so that the trash bag can be secured to the inlet scoop. The present invention is generally rectangular shaped so that it can be placed on the surface of the ground and maintain itself in an upright position so that leaves and trash can be easily raked into the larger end of the inlet scoop so that the hands of a user are free to rake. An enlarged portion disposed on each corner of the smaller end also provides additional clearance for the protuberance when the inlet scoops are stacked on top of each other, as would occur during storage or shipment, so that no damage is done to the protuberance.

An object of the present invention is to provide an inlet scoop for raking, scooping or placing trash or other materials into a conventional trash bag so that the hands of a user are free allowing the user to conveniently rake or otherwise place trash or other material into the mouth or opening of the trash bag. A further object of the present invention is to provide an inlet scoop that requires no clips or fasteners for holding the conventional trash bag onto the frame of the inlet scoop. A further object of the present invention is to provide an inlet scoop which can be placed on the surface of the ground in such a way that it is stable and will maintain itself in an upright position allowing the user to more easily rake or place leaves into the trash bag. A further object of the present invention is to provide an inlet scoop which can be easily operated by a user. A further object of the present invention is to provide an inlet scoop which can be easily and relatively inexpensively manufactured.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which:

FIG. 1 is a perspective view of the present invention shown in operative connection.

FIG. 2 is a side view of the present invention shown in operative connection.

LIST OF REFERENCE NUMERALS

Figure 3:
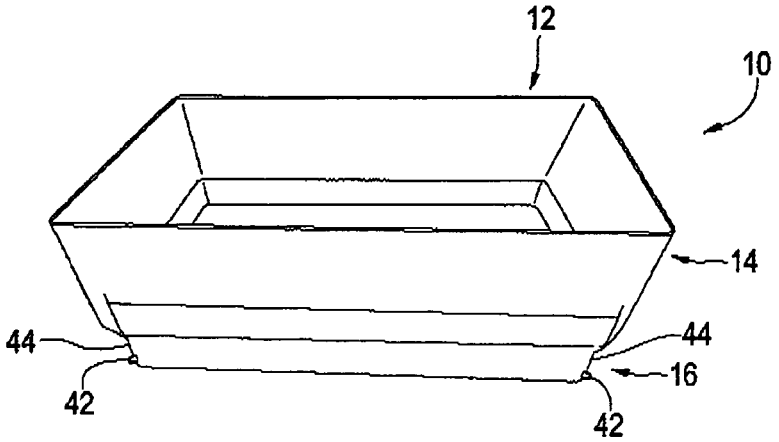
FIG. 3 is a perspective view of the present invention.

With regard to reference numerals used, the following numbering is used throughout the drawings.

10 present invention
12 inlet scoop
14 larger inlet end
16 smaller outlet end
18 trash bag
20 open mouth of trash bag
21 closed end of trash bag
22 surface of ground
24 user
26 hands of user
28 rake
30 leaves
32 opening of inlet scoop
34 upper longer edge
36 lower longer edge
38 left shorter edge
40 right shorter edge
42 nipple
44 corner
45 non-convergent portion
46 enlarged portion

DETAILED DESCRIPTION OF THE PREFERRED EMBODIMENT

The following discussion describes in detail at least one embodiment of the present invention. This discussion should not be construed, however, as limiting the present invention to the particular embodiments described herein since practitioners skilled in the art will recognize numerous other embodiments as well. For a definition of the complete scope of the invention the reader is directed to the appended claims. FIGS. 1 through 5 illustrate the present invention wherein an inlet scoop for a conventional trash bag is disclosed and which is generally indicated by reference number 10.

Turning to FIG. 1, therein is shown the present invention 10 being an inlet scoop 12 and having a larger inlet end 14 and a smaller outlet end 16 to which smaller end a conventional trash bag 18 having an outlet or closed end 21 and a inlet mouth or opening 20 thereon can be attached to the smaller end of the inlet scoop 12 in such a way that the inlet scoop can be placed on the surface 22 of the ground so that a user 24 can keep his hands 26 free to hold rake 28 to rake leaves 30 easily from the ground into the opening 32 of the inlet scoop 12. It can be seen that the inlet scoop 12 is a generally rectangular, walled structure and somewhat funnel shaped having an upper longer wall or edge 34, a lower wall longer or edge 36, a left shorter wall or edge 38, and a right shorter wall or edge 40 so that a funnel effect is produced as leaves 30 are raked from the larger end 14 toward the smaller end 16. The larger end 14 has a greater cross sectional area than the smaller end 16. An enlarged portion 46 on each corner 44 is also shown. The present invention 10 provides an inlet scoop 12 which has an opening 32 for receiving and channeling the raked leaves 30 along a desired path into the mouth 20 of the trash bag 18.

Turning to FIG. 2, therein is shown the present invention 10 being an inlet scoop 12 and having a larger end 14 and a smaller end 16 to which smaller end a conventional trash bag 18 having a closed end 21 and a mouth thereon 20 can be attached in such a way that the inlet scoop 12 can be placed on the surface 22 of the ground so that a user can rake leaves easily into the opening 32 of the inlet scoop 12. It can be seen that the larger and smaller ends 14, 16 of the inlet scoop 12 are generally rectangular shaped and somewhat funnel shaped because the walls or edges 34, 36, 38, 40 slope inwardly toward each other so that a funnel effect is produced as leaves are raked from the larger end 14 toward the smaller end 16. One of the longer edges 34 or 36 rests on the ground 22 to provide maximum stability. A nipple or protuberance 42 protrudes from each corner 44 of the smaller end 16 of the inlet scoop 12 so that the opening 20 of the trash bag 18 can be hooked onto or over the nipple so as to become captured on the nipple 42 so that the opening 20 of the trash bag 18 is firmly and securely attached to the nipple and thereby the smaller end of the inlet scoop. The nipple 42 is effectively sized in length and diameter so that it can be manufactured in an effective size to effectively capture the opening 20 of the trash bag 18 thereon. An enlarged portion 46 on each corner 44 is also shown.

Figure 4:
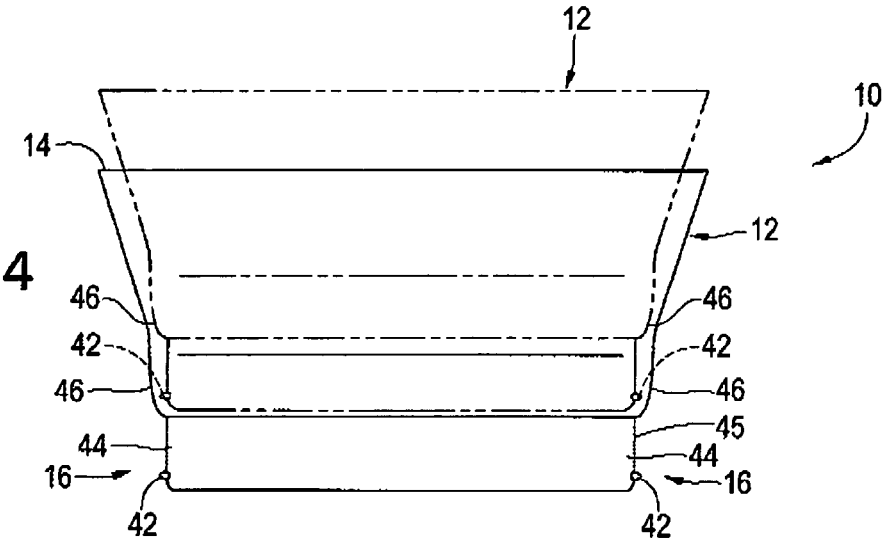
FIG. 4 is a side view of the present invention.

Turning to FIGS. 3 and 4, therein is shown the present invention 10 being an inlet scoop 12 and having a larger end 14 and a smaller end 16 to which smaller end a conventional trash bag can be attached as previously disclosed. It can be seen that the larger end 14 of the inlet scoop 12 is generally rectangular shaped having an upper, a lower, a left edge and a right edge so that a funnel effect is produced as leaves are raked from the larger end 14 toward the smaller end 16. A nipple 42 protrudes or extends laterally away from each corner 44 of the smaller end 16 of the inlet scoop 12 so that the opening of the trash bag can be placed onto or captured by the nipple 42 so that the opening of a trash bag is firmly and securely attached to the smaller end 16 of the inlet scoop 12. An enlarged portion 46 disposed on each corner 44 of the smaller end 16 also provides additional clearance for the protuberance 42 when the inlet scoops 12 are stacked on top of each other, as would occur during storage or shipment, so that no damage is done to the protuberance as shown in FIG. 4. FIG. 4 shows how the protuberance 42 of the upper inlet scoop 12 fits inside the enlarged portion 46 of the lower inlet scoop 12. While FIG. 4 only shows a stack of two inlet scoops 12, it would be understood that the stack could include several inlet scoops 12 as might occur during storage or shipment.

As illustrated, there is a non-convergent portion 45 extending from the narrow end of the smaller outlet end of the convergent portion to the outlet end of inlet scoop 12.

Figure 5:
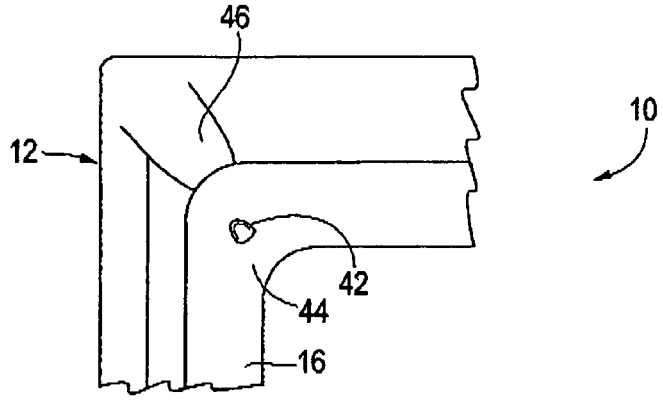
FIG. 5 is a bottom view of portions of the present invention.

Turning to FIG. 5, therein is shown a nipple 42 protruding from a corner 44 of the smaller end 16 of the inlet scoop 12 so that the opening of a trash bag can be placed onto and captured by the nipple 42. An enlarged portion 46 on corner 44 is also shown.

I claim:

1. An inlet scoop for securely attaching a trash bag thereto and for filling the trash bag with leaves, grass or debris, comprising:

a) the inlet scoop being substantially rectangular shaped and having a larger inlet end and a smaller outlet end, a plurality of walls including upper and lower walls and left and right walls, wherein said walls slope inwardly toward each other with a non-convergent portion leading to said smaller outlet end to funnel the leaves into an open mouth of the trash bag, and, a plurality of corners disposed thereon;

b) a nipple disposed on each said corner on said non-convergent portion proximate said smaller outlet end of said inlet scoop;

c) the open mouth of the trash bag being hooked onto each said nipple to securely attach the open mouth of the trash bag to said smaller outlet end of said inlet scoop; and d) said inlet scoop with trash bag hooked thereonto lying on a ground surface supported on said ground surface by said nipples and an outer edge of a wall at said larger inlet end, whereby a user has both hands available for shoveling leaves, grass or debris into said trash bag through said inlet scoop directly off said ground surface.

2. The apparatus of claim 1, wherein said inlet scoop has an enlarged portion proximate said smaller outlet end between said non-convergent portion and said larger inlet end so that a plurality of inlet scoops are stackable while providing clearance for said nipples or protuberances.

3. A method for an inlet scoop which securely holds a trash bag thereto and for filling the trash bag with leaves, grass or debris, comprising the steps of:

a) providing an inlet scoop being substantially rectangular shaped and having a larger inlet end and a smaller outlet and, a plurality of walls including upper and lower walls and left and right walls wherein the walls are sloped inwardly toward each other with a non-convergent portion leading to said smaller outlet end so as to funnel the leaves into an open mouth of the trash bag, and, having a plurality of corners thereon;

b) providing a nipple on each corner on said non-convergent portion proximate the smaller outlet end of the inlet scoop;

c) hooking the open mouth of the trash bag onto each nipple on each corner thereby securing the open mouth of the trash bag to the smaller outlet end of the inlet scoop; and d) placing said inlet scoop with trash bag hooked thereonto on a ground surface and supported on said ground surface by said nipples and an outer edge of a wall at said larger inlet end, whereby a user has both hands available for shoveling leaves, grass or debris into said trash bag through said inlet scoop directly off said ground surface.

4. The method of claim 3, further comprising the step of enlarging a portion of each corner between said non-convergent portion and said larger inlet end so that a plurality of inlet scoops are stackable while providing clearance for said nipples or protuberances.

5. A stack of inlet scoops, each scoop designed for securely attaching trash bag thereto and for filling the trash beg with leaves, grass or debris, comprising:

a) each inlet scoop being substantially rectangular shaped and having a larger inlet end and a smaller outlet end, a plurality of walls sloped inwardly toward each other so as to funnel the leaves into an open month of the trash bag, a non-convergent portion adjacent said smaller outlet end, a nipple on each corner of said non-convergent portion proximate the smaller outlet end of the inlet scoop adapted to hook an open mouth of the trash bag for securing the open mouth of the trash bag to the smaller outlet end of the inlet scoop when deployed for use while lying on a ground surface with said scoop supported at one end by said nipples and by an outer edge of a wall forming said larger outlet;

b) an upper inlet scoop in said stack having the smaller outlet end thereof inserted into the larger outlet end of a lower inlet scoop directly below in said stack for storage or transportation of said inlet scoops; and c) each of said inlet scoops having an enlarged portion adjacent said non-convergent portion for providing clearance for said nipples or protuberances on each upper inlet scoop in said stack of inlet scoops.

* * * * *